US010378349B2

(12) United States Patent
Ritzmann et al.

(10) Patent No.: US 10,378,349 B2
(45) Date of Patent: Aug. 13, 2019

(54) METHODS OF PLOTTING ADVANCED LOGGING INFORMATION

(71) Applicants: Nicklas Jeremias Ritzmann, Niedersachsen (DE); Stefan Schimschal, Niedersachsen (DE)

(72) Inventors: Nicklas Jeremias Ritzmann, Niedersachsen (DE); Stefan Schimschal, Niedersachsen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 406 days.

(21) Appl. No.: 15/139,475

(22) Filed: Apr. 27, 2016

(65) Prior Publication Data

US 2016/0312609 A1 Oct. 27, 2016

Related U.S. Application Data

(60) Provisional application No. 62/153,122, filed on Apr. 27, 2015.

(51) Int. Cl.
*G06F 11/30* (2006.01)
*E21B 49/08* (2006.01)

(52) U.S. Cl.
CPC ..... *E21B 49/08* (2013.01); *E21B 2049/085* (2013.01)

(58) Field of Classification Search
CPC combination set(s) only.
See application file for complete search history.

(56) References Cited

U.S. PATENT DOCUMENTS

2004/0000400 A1 1/2004 Fujisawa et al.
2004/0016289 A1 1/2004 Zamfes
2011/0088949 A1 4/2011 Zuo et al.
2014/0278113 A1* 9/2014 Chok ..... E21B 49/088 702/13

(Continued)

OTHER PUBLICATIONS

Haworth et al., "Interpretation of Hydrocarbon Shows Using Light (C1-05) Hydrocarbon from Mud-Log Data", The American Association of Petroleum Geologists Bulletin, V. 69, No. 8 (Aug. 1985) p. 1305-1310 (Year: 1985).*

(Continued)

*Primary Examiner* — Phuong Huynh
(74) *Attorney, Agent, or Firm* — Cantor Colburn LLP

(57) ABSTRACT

An embodiment of an apparatus for estimating and displaying formation and formation fluid properties includes a sampling device coupled to borehole fluid, the borehole fluid including hydrocarbons released from a region of the formation surrounding an interval of the borehole. The apparatus also includes an analysis unit configured to analyze the sample of the borehole fluid at each of a plurality of sample times and estimate amounts of hydrocarbons in the borehole fluid, and a processing device configured to estimate one or more ratios of an amount of at least one hydrocarbon gas to an amount of at least another hydrocarbon gas at each sample time, analyze the one or more ratios to estimate a type of hydrocarbon fluid associated with the ratio, and automatically generate a fluid log that displays an indication of the type at each of the plurality of sample times.

20 Claims, 9 Drawing Sheets

(56) References Cited

U.S. PATENT DOCUMENTS

2015/0039235 A1 2/2015 Wiener et al.

OTHER PUBLICATIONS

Haworth, et al., "Interpretation of Hydrocrabon Shows Using Light (C1-C5) Hydrocarbon gases from Mud-Log Data", The American Association of Petroleum Geologists Bulletin, V. 69, No. 8 (Aug. 1985) p. 1305-1310, 4 total pages.
Notification of Transmittal of the International Search Report and the Written Opinion of the International Searching Authority, or the Declaration; PCT/US16/029447 ; dated Aug. 9, 2016; 11 pages.
Pixler, B.O., "Formation Evaluation by Analysis of Hydrocarbon Ratios", Journal of Petroleum Technology, Jun. 1969, pp. 665-670.

* cited by examiner

METHODS OF PLOTTING ADVANCED LOGGING INFORMATION

CROSS REFERENCE RELATED APPLICATIONS

This application claims the benefit of an earlier filing date from U.S. Provisional Application Ser. No. 62/153,122 filed Apr. 27, 2015, the entire disclosure of which is incorporated herein by reference.

BACKGROUND

During subterranean drilling and completion operations, a pipe or other conduit is lowered into a borehole in an earth formation during or after drilling operations. Such pipes are generally configured as multiple pipe segments to form a "string", such as a drill string or production string. As the string is lowered into the borehole, additional pipe segments are coupled to the string by various coupling mechanisms, such as threaded couplings.

Mud logging and/or gas logging is a commonly applied service for the hydrocarbon industry and is referred to as the extraction and measurement of hydrocarbons in fluid (e.g., drilling mud), which may be dissolved, contained as bubbles or microbubbles, and/or otherwise present in the fluid. Measurements are conducted during a drilling operation with a Mass Spectrometer, a Gas Chromatograph, a combination thereof, an optical sensor, any other gas measurement device, or can be derived from fluid samples previously taken.

BRIEF DESCRIPTION

An embodiment of an apparatus for estimating and displaying formation and formation fluid properties includes a sampling device coupled to borehole fluid circulated through a borehole in an earth formation, the borehole fluid including hydrocarbons released from a region of the formation surrounding an interval of the borehole, the sampling device configured to sample the borehole fluid at a plurality of sample times during a downhole operation. The apparatus also includes an analysis unit configured to analyze the sample of the borehole fluid at each sample time and estimate amounts of hydrocarbons in the borehole fluid, and a processing device configured to estimate one or more ratios of an amount of at least one hydrocarbon gas to an amount of at least another hydrocarbon gas at each sample time, analyze the one or more ratios to estimate a type of hydrocarbon fluid associated with the ratio, and automatically generate a fluid log that displays an indication of the type at each of the plurality of sample times.

An embodiment of a method of estimating and displaying formation and formation fluid properties includes sampling a borehole fluid circulated through a borehole in an earth formation at a plurality of sample times during a downhole operation, the borehole fluid including hydrocarbons released from a region of the formation surrounding an interval of the borehole, and analyzing, by an analysis unit, the sample of the borehole fluid at each sample time and estimating amounts of hydrocarbons in the borehole fluid. The method also includes estimating, by a processing device, one or more ratios of an amount of at least one hydrocarbon gas to an amount of at least another hydrocarbon gas at each sample time, analyzing the one or more ratios to estimate a type of hydrocarbon fluid associated with the ratio, automatically generating a fluid log that displays an indication of the type at each of the plurality of sample times, and performing aspects of the energy industry operation based on the fluid log.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

Figure 1:
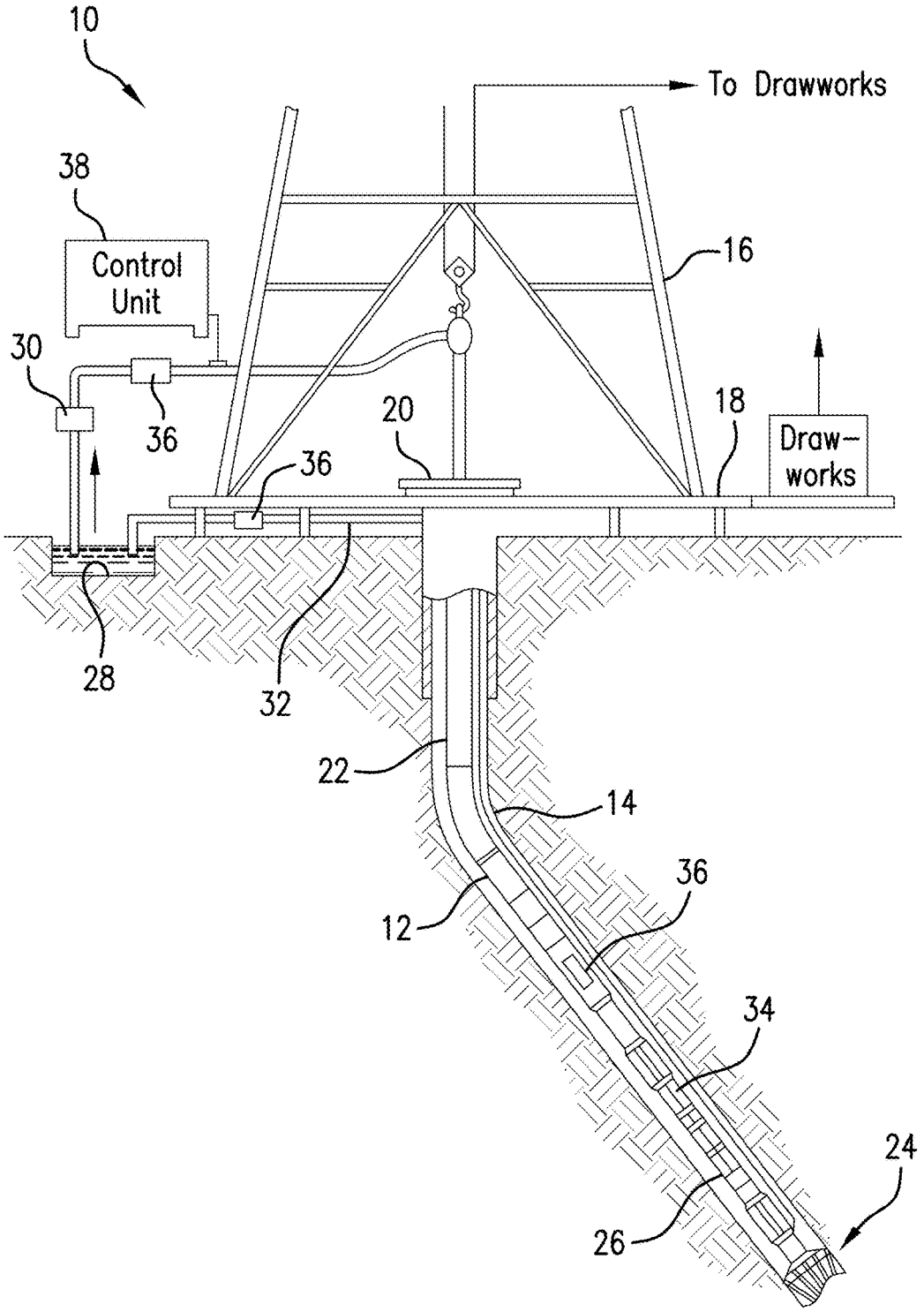
FIG. 1 depicts an exemplary embodiment of a well drilling and/or logging system.

Disclosed herein are methods of plotting information based on analysis of hydrocarbons transported in the drilling mud or derived from the formation, using other methods, like fluid sampling devices, well tests, etc. The plots may inform an operator (human or computer) if changes are needed to optimize drilling parameters or directions, reservoir evaluation or other energy industry operations. In one embodiment, systems apparatuses and methods are provided that display an indication of hydrocarbon types at one or more sample times (e.g., at each of a plurality of sample times or successive sample times), such as a permeability index, highlighting borehole intervals with an expected higher productivity Referring to FIG. 1, an exemplary embodiment of a well drilling, measurement, evaluation and/or production system 10 includes a borehole string 12 that is shown disposed in a borehole 14 that penetrates at least one earth formation during a downhole operation, such as a drilling, measurement and/or hydrocarbon production operation. In the embodiment shown in FIG. 1, the borehole string is configured as a drill string. However, the system 10 and borehole string 12 are not limited to the embodiments described herein, and may include any structure suitable for being lowered into a wellbore or for connecting a drill or downhole tool to the surface. For example, the borehole string 12 may be configured as wired pipe, coiled tubing, a wireline or a hydrocarbon production string.

In one embodiment, the system 10 includes a derrick 16 mounted on a derrick floor 18 that supports a rotary table 20 that is rotated by a prime mover at a desired rotational speed. The drill string 12 includes one or more drill pipe sections 22 or coiled tubing, and is connected to a drill bit 24 that may be rotated via the drill string 12 or using a downhole mud motor. The system 10 may also include a bottomhole assembly (BHA) 26.

During drilling operations a suitable drilling fluid from, e.g., a mud pit 28 is circulated under pressure through the drill string 12 by one or more mud pumps 30. The drilling fluid passes into the drill string 12 and is discharged at a wellbore bottom through the drill bit 24, and returns to the surface by advancing uphole through an annular space between the drill string 12 and a wall of the borehole 14 and through a return line 32.

Various sensors and/or downhole tools may be disposed at the surface and/or in the borehole 14 to measure parameters of components of the system 10 and or downhole parameters. Such parameters include, for example, parameters of the drilling fluid (e.g., flow rate, temperature and pressure), environmental parameters such as downhole vibration and hole size, operating parameters such as rotation rate, weight-on-bit (WOB) and rate of penetration (ROP), and component parameters such as stress, strain and tool condition. Other parameters may include quality control parameters, such as data classifications by quality, or parameters related to the status of equipment such as operating hours and the composition of the liberated formation fluid.

For example, a downhole tool 34 is incorporated into any location along the drill string 12 and includes sensors for measuring downhole fluid flow and/or pressure in the drill string 12 and/or in the annular space to measure return fluid flow and/or pressure. Additional sensors 36 may be located at selected locations, such as an injection fluid line and/or the return line 32. Such sensors may be used, for example, to regulate fluid flow during drilling operations. Downhole tools and sensors may include a single tool or multiple tools disposed downhole, and sensors may include multiple sensors such as distributed sensors or sensors arrayed along a borehole string. In addition to downhole sensors, sensors may be included at the surface, e.g., in surface equipment.

In one embodiment, the downhole tool 34, the BHA 26 and/or the sensors 36 are in communication with a surface processing unit 38. In one embodiment, the surface processing unit 38 is configured as a surface drilling control unit which controls various production and/or drilling parameters such as rotary speed, weight-on-bit, fluid flow parameters, pumping parameters. The surface processing unit 38 may be configured to receive and process data, such as measurement data and modeling data, as well as display received and processed data. Any of various transmission media and connections, such as wired connections, fiber optic connections, wireless connections and mud pulse telemetry may be utilized to facilitate communication between system components.

The downhole tool 34, BHA 26 and/or the surface processing unit 38 may include components as necessary to provide for storing and/or processing data collected from various sensors therein. Exemplary components include, without limitation, at least one processor, storage, memory, input devices, output devices and the like.

The sensors and downhole tool configurations are not limited to those described herein. The sensors and/or downhole tool 34 may be configured to provide data regarding measurements, communication with surface or downhole processors, as well as control functions. Such sensors can be deployed before, during or after drilling, e.g., via wireline, measurement-while-drilling ("MWD") or logging-while-drilling ("LWD") components. Exemplary parameters that could be measured or monitored include resistivity, density, porosity, permeability, acoustic properties, nuclear-magnetic resonance properties, formation pressures, properties or characteristics of the fluids downhole and other desired properties of the formation surrounding the borehole 14. The system 10 may further include a variety of other sensors and devices for determining one or more properties of the BHA (such as vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.

As described herein, "uphole" refers to a location near the point where the drilling started relative to a reference location when the string 12 is disposed in a borehole, and "downhole" refers to a location away from the point where the drilling started along the borehole relative to the reference location. It shall be understood that the uphole end could be below the downhole end without departing from the scope of the disclosure herein.

As described herein, "drillstring" or "string" refers to any structure or carrier suitable for lowering a tool through a borehole or connecting a drill bit to the surface, and is not limited to the structure and configuration described herein. For example, a string could be configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's and drill strings.

Figure 2:
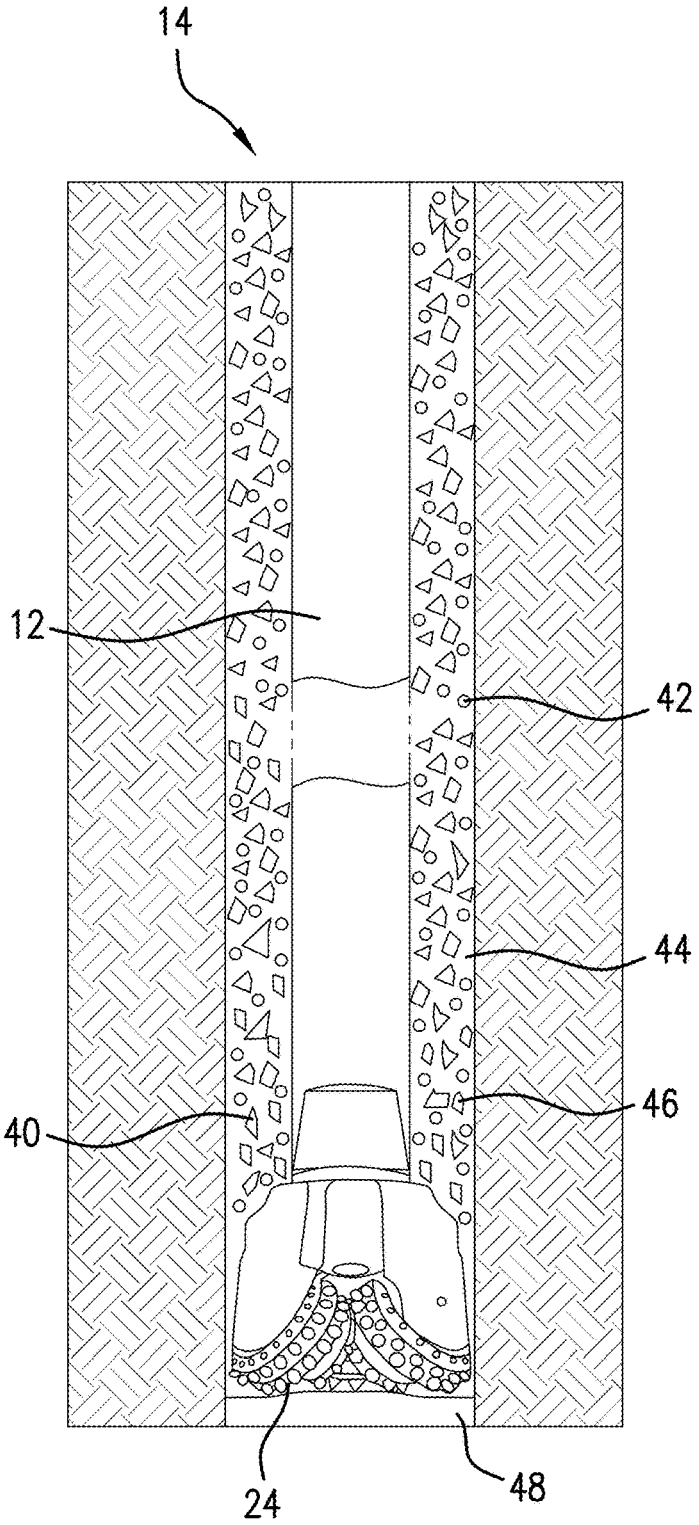
FIG. 2 depicts a portion of the wellbore shown in FIG. 1 and includes example locations of gas located in the drilling mud and its possible sources.

With reference now to FIG. 2, a standard drilling process is described. In particular, and as briefly described above, the process includes circulating drilling mud 40 through the borehole 14, in order to establish well control, cutting removal and bit cooling. When drilling through a medium containing gas, condensate or oil, hydrocarbons may be released from the penetrated interval. The released hydrocarbons are then transported to the surface within the drilling mud. Additional gas may be released into the mud from oil or condensate components, due to changing PVT (pressure-volume-temperature) conditions from subsurface to surface. The amount of released gas (e.g., mass or volume), not bound or trapped in or on the cuttings, depends on the porosity, permeability and hydrocarbon saturation of the formation. From there the mud and hydrocarbon mixture is then pumped through an extraction and/or sampling system and the extracted gas will be recorded.

In FIG. 2, the mud 40 includes several different locations where gas may exist. For instance, the mud may include gas 42 in a bubble phase in the mud 40 and/or dissolved gas 44 in the drilling mud 15. Gas may also exist in cuttings 46 where low permeability and isolated pores may prevent hydrocarbons from migrating into the mud. In FIG. 2, element 48 indicates a portion of the formation that is producing the gas. Gas may be liberated, for example, by breaking up the formation in normal drilling operation, due to drilling induced fractures or using existing natural fractures.

Mud logging/gas logging is one commonly applied service for the hydrocarbon industry and is referred to as the extraction and measurement of hydrocarbons in borehole fluid, which may be dissolved and/or contained as bubbles or microbubbles in fluid such as drilling mud. Measurements may be conducted during a drilling operation with a Mass Spectrometer, a Gas Chromatograph, a combination thereof, an optical sensor, any other gas measurement device, or can be derived from fluid samples previously taken. The mud logging may be conducted at the surface or downhole. For example, fluid samples may be taken and analyzed by a surface analyzer, or taken downhole and analyzed by a downhole measurement device such as a downhole gas analyzer. It is noted that the embodiments described herein are not limited to any particular method or technique for sampling or analyzing hydrocarbons from borehole fluid, such as fluid sampling devices, well tests, etc.

Of particular relevance to the industry are the hydrocarbons which are released from the penetrated lithological units and recorded once they become evaporated into gaseous phase under atmospheric conditions. Such hydrocarbons are referred to herein as gaseous hydrocarbons or simply gases. Ideally, the hydrocarbons originate only from the milled formation and can therefore provide highly valuable information when correlated with the corresponding depth and corrected for artifacts such as recycled, connection and/or tripping gas.

Conventional hydrocarbon extraction is accomplished by a gas trap or other device that can be used to extract hydrocarbons. For example, extraction is accomplished by feeding the mud through a vessel with a mechanical agitator and sucking the evaporated hydrocarbons from the headspace of the trap towards the measuring unit. Any suitable device or system can be used to extract hydrocarbons and is not limited to the examples and embodiments described herein.

Based on the measured hydrocarbon compositions, the type(s) of fluids present in the subsurface, as well as features such as gas/oil, oil/water and gas/water contact can be determined.

Embodiments described herein use algorithms for geometric analysis of ratio plots, on a time by time and/or depth by depth basis, which can be used to automatically generate a continuous log. These plots can then be further calibrated, e.g., using a measured permeability from core, NMR, pressure temperature volume (PVT) analysis of formation fluid samples, etc. Information related to certain ratio plots (e.g., Pixler & Triangular) can be displayed in a log, and used to derive properties such as a permeability index of reservoir intervals. As described herein, a "continuous log" is a log or display that presents data measured by an analysis tool at each of a plurality of successive sample times.

In one embodiment, analyses of gas content information are performed automatically and translated into one dimensional continuous logs. In some instances, a multidimensional log may be generated. The automatic analysis and creation of logs as described herein avoids the deficiencies of conventional techniques, which typically involve creating individual gas analysis plots (gas analysis method). Such conventional techniques are time consuming and the amount of interpretation plots might quickly lead to confusion.

Regardless of how the gas enters the mud, mud logging/gas logging is one commonly applied service for the hydrocarbon industry and is referred to as the extraction and measurement of hydrocarbons which are present in the drilling mud. Measurements are conducted during a drilling operation with a mass spectrometer, a gas chromatograph or a combination thereof for example, on mud extracted from the mud pit 28, sampled downhole, or that is returning from the borehole 14.

There are several different manners in which information related to gas content may be assembled. The gas content information is assembled into a simple user readable single format display that combines many of the possible displays.

Figure 3:
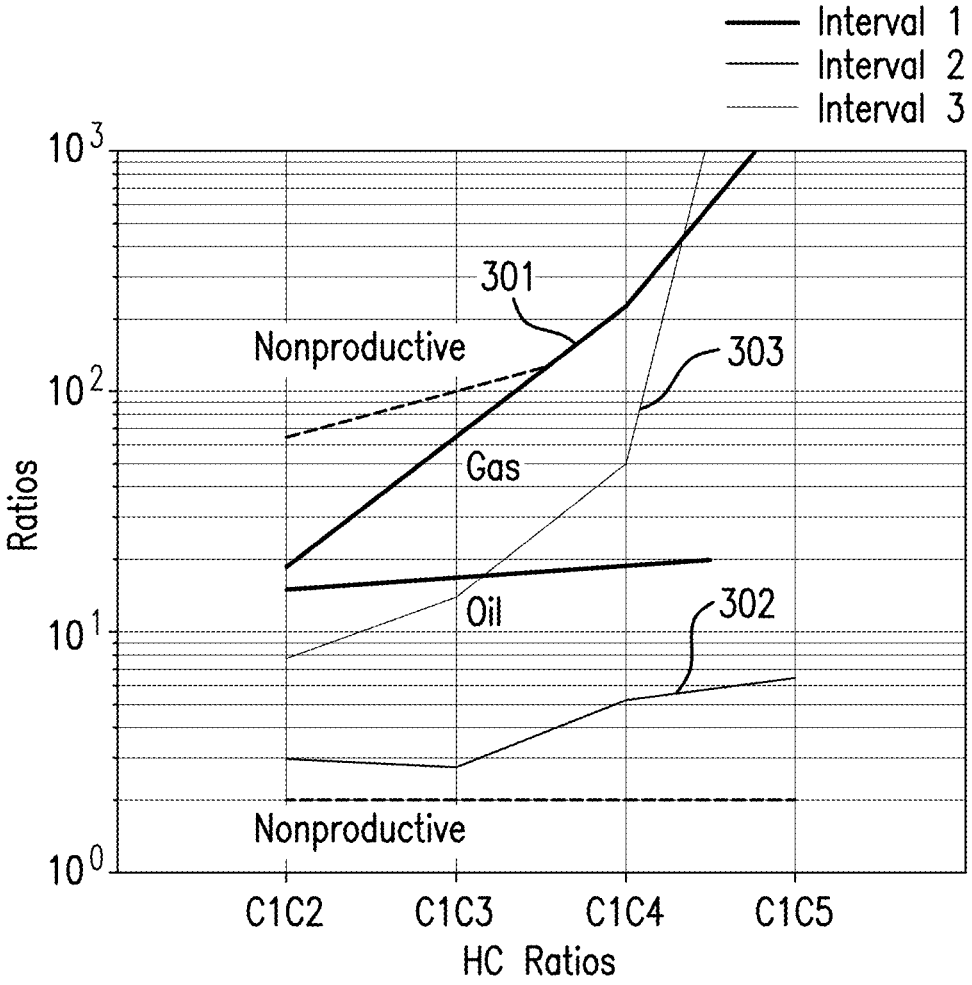
FIG. 3 depicts an example of a Pixler plot.

One tool used in evaluating mud or other borehole fluid includes determining the ratios of methane (C1) to, respectively, ethane (C2), propane (C3), butane isotopes (C4), and pentane isotopes (C5) and heavier (C6+). These ratios (e.g., the molar or volumetric ratio of methane to ethane) may be crossplotted or correlated with fluid type to form a so-called Pixler plot. For example, FIG. 3 shows an example of Pixler plot for three different intervals represented by traces 301, 302 and 303. Trace 301 is from a gas zone and traces 302 and 303 are from oil zones. Each trace is defined by a value of each of four different ratios, although any number or type of gas ratio may be used. In this plot the ratios are as follows:

$$C1C2 = \frac{C1}{C2}$$

$$C1C3 = \frac{C1}{C3}$$

$$C1C4 = \frac{C1}{C4}$$

$$C1C5 = \frac{C1}{C5}$$

The first Pixler ratio (C1C2) indicates the fluid type present in the selected interval, where low values are an indication for heavier hydrocarbons and high values an indication for lighter hydrocarbons. The steepness of the slope between the different ratios of each curve gives an index for the permeability of the analysed interval. Generally speaking the gentler the slope, the more likely the interval is permeable. Additionally, at least one negative trend in the ratio line of the Pixler plots, as demonstrated with trace 102, indicates a high potential for a water flushed/charged zone.

Figure 4A:
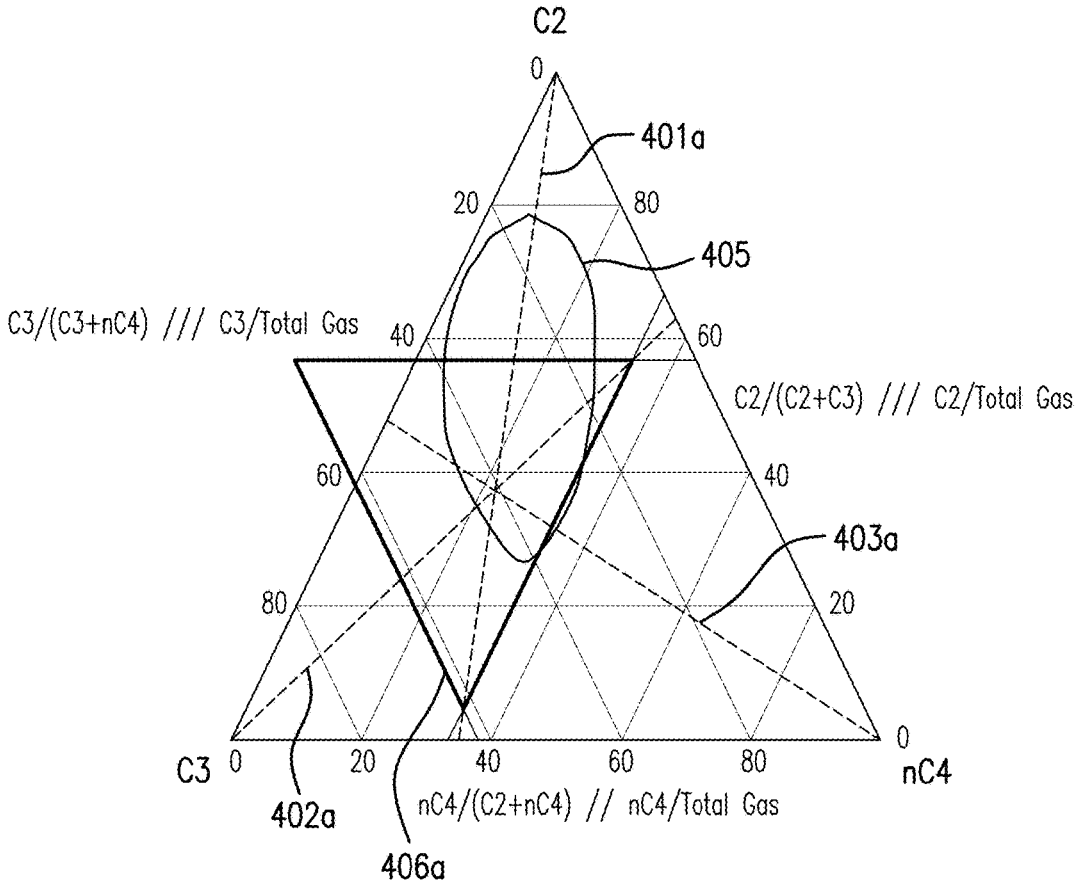
FIGS. 4*a* and 4*b* show two different triangular plots.
Figure 4B:
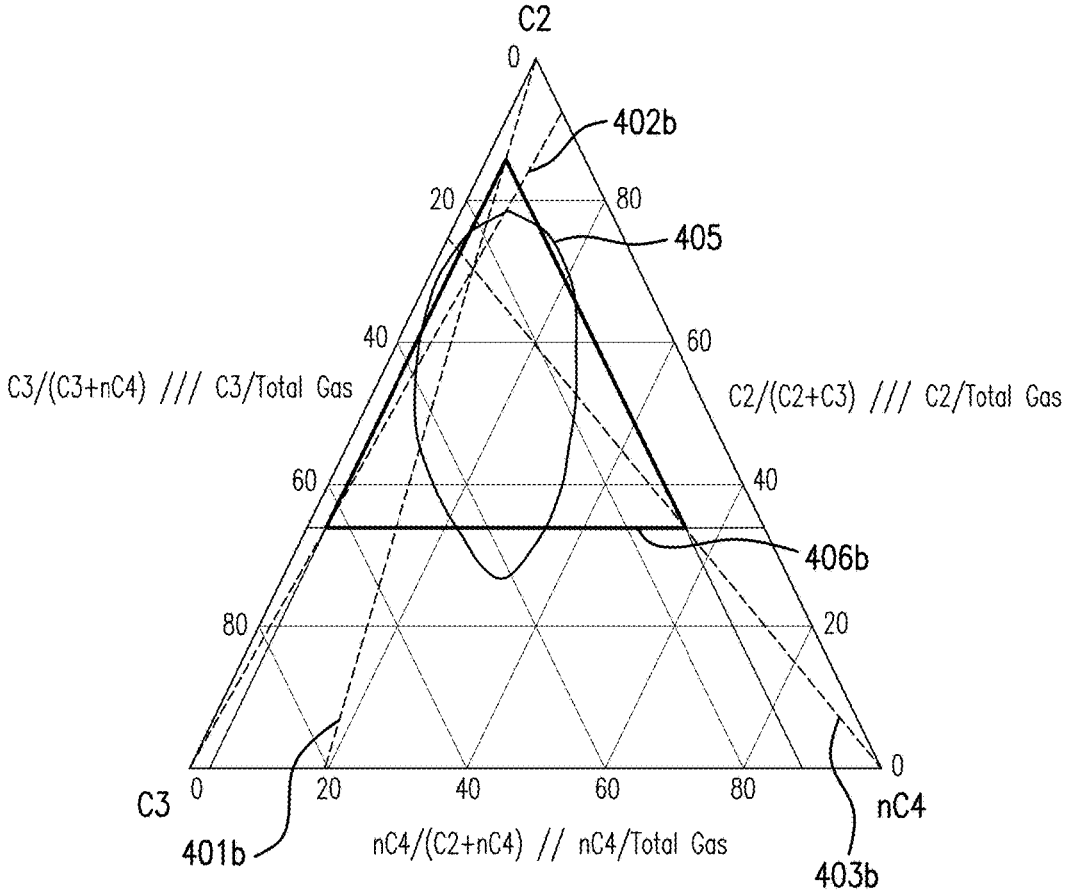

From the Pixler ratios, triangular ratios may be plotted as shown in FIGS. 4*a* and 4*b*. FIG. 4*a* represents a productive oil zone and FIG. 4*b* represents a productive gas zone. Permeability indicating ratios may be calculated based on ratios of gas content and/or based on the triangular ratios. For example, the following triangular/productivity ratios are calculated as follows:

$$TRpr1 = \frac{C2}{C2 + C3}$$

$$TRpr2 = \frac{C3}{C3 + nC4}$$

$$TRpr3 = \frac{nC4}{C2 + nC4}$$

In the above ratios, "n" refers to normal (straight chained) isomer. In FIGS. 4*a* and 4*b* traces 401*a*, 402*a* and 403*a* and 401*b*, 402*b* and 403*b*, respectively, are defined by one of the calculated productivity ratios above and the opposite corner of the triangle. For example, Trace 401*a* originates at a point on the bottom side of the triangle that corresponds to the value of TRpr3, and extends to the opposite corner of the triangle. In some cases, it is known or empirically estimated what values determine potentially productive (permeable) intervals. In FIGS. 4*a* and 4*b*, this is shown by ellipse 405. The three traces on each graph intersect at one point inside of the triangle. This intersection point gives an indication whether the selected interval is potentially productive (e.g., it is productive if within the ellipse 405). The next piece of information that may be gathered from a triangle plot is whether the interval being investigated is a permeable heavier hydrocarbon zone or a permeable light hydrocarbon zone. To this end, fluid type triangular ratios are found as follows:

1st fluid type triangular ratio:

$$TRfl1 = \frac{C2}{TG}$$

2nd fluid type triangular ratio:

$$TRfl2 = \frac{C3}{TG}$$

3rd fluid type triangular ratio:

$$TRfl3 = \frac{nC4}{TG},$$

where TG=total gas (the sum of all individual components). These three lines will intersect in three points inside or outside of the triangle, defining an intersection triangle 406*a* and/or 406*b*. If the intersection triangle is pointing upwards, the interval is light hydrocarbon bearing (such as e.g. gas) (as shown in FIG. 4*a*); if the intersection triangle points downwards, it indicates a heavier fluid type (such as e.g. oil) (as shown in FIG. 4*a*). Furthermore, the size of the intersection triangle gives an indication about the density of the fluids. For downward pointing triangles, the larger the intersection triangle, the denser the oil. For upward pointing triangles, the larger the intersection triangle, the lesser dense the gas.

Figures 5A, 5B, 5C:
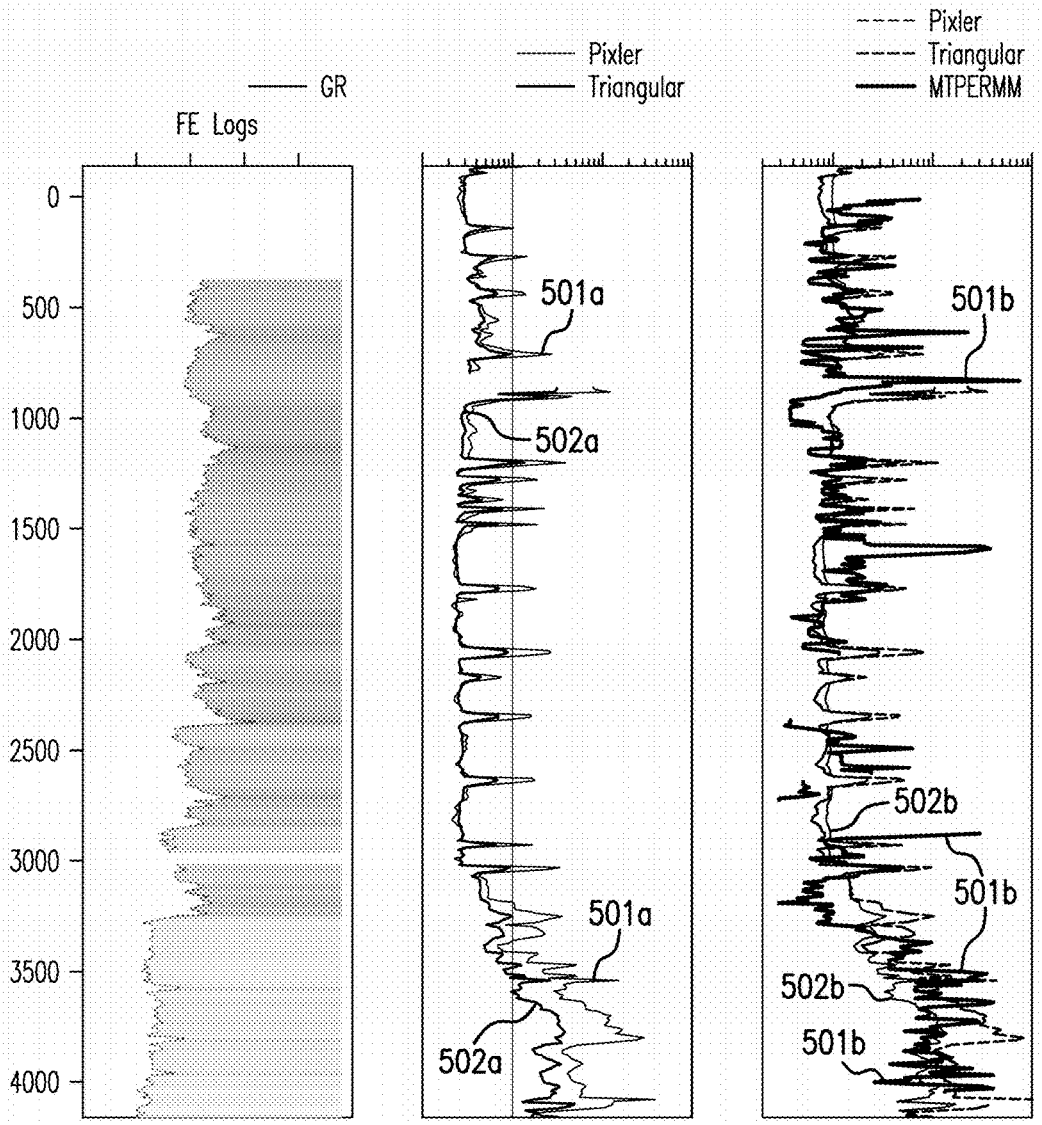
FIGS. 5*a*-5*c* show a continuous log according to one embodiment.

The above tools, while useful, can in some cases be difficult to read. Herein is a provided method of combining gas ratio information, such as Pixler and triangle information, into an easily readable chart, an example of which is shown in FIGS. 5*a*, 5*b* and 5*c*, collectively referred to as FIG. 5. In one embodiment, curves relating to gas ratios are displayed on a log.

In one embodiment, the log includes one or more curves generated by one or more Pixler plots. One curve represents the steepness of a regression line fitted through the Pixler ratios on a depth by depth basis. This curve is shown in FIGS. 5*b* and 5*c* as traces 501*a* and 501*b*. Another approach is to examine the slope steepness of the C1C2 ratio compared to the other ratios (e.g., C1C2 & C1C3, C1C2 & C1C4, C1C2 & C1C5).

In one embodiment, the log includes one or more curves derived from one or more triangular plots. For example, curves 502*a* and 502*b* represent the distance between the intersection point of traces in a triangular plot, such as the intersection between traces shown in FIGS. 4*a* and 4*b* and the center of an area representing potentially permeable intervals (e.g., the ellipse 405).

Another tool using the same components from above includes calculation of Haworth ratios. The Haworth ratios are calculated as stated below. They yield information about the fluid character and indicate whether an interval might be productive or not. The data may be displayed on a continuous log as demonstrated in an example shown in FIG. 6.

Wetness Ratio:

$$\mathrm{Wh} = \frac{C2 + C3 + C4 + C5}{C1 + C2 + C3 + C4 + C5} * 100$$

Balance Ratio:

$$Bh = \frac{C1 + C2}{C3 + C4 + C5}$$

Character Ratio:

-continued $$Ch = \frac{C4 + C5}{C3}$$

Figure 6:
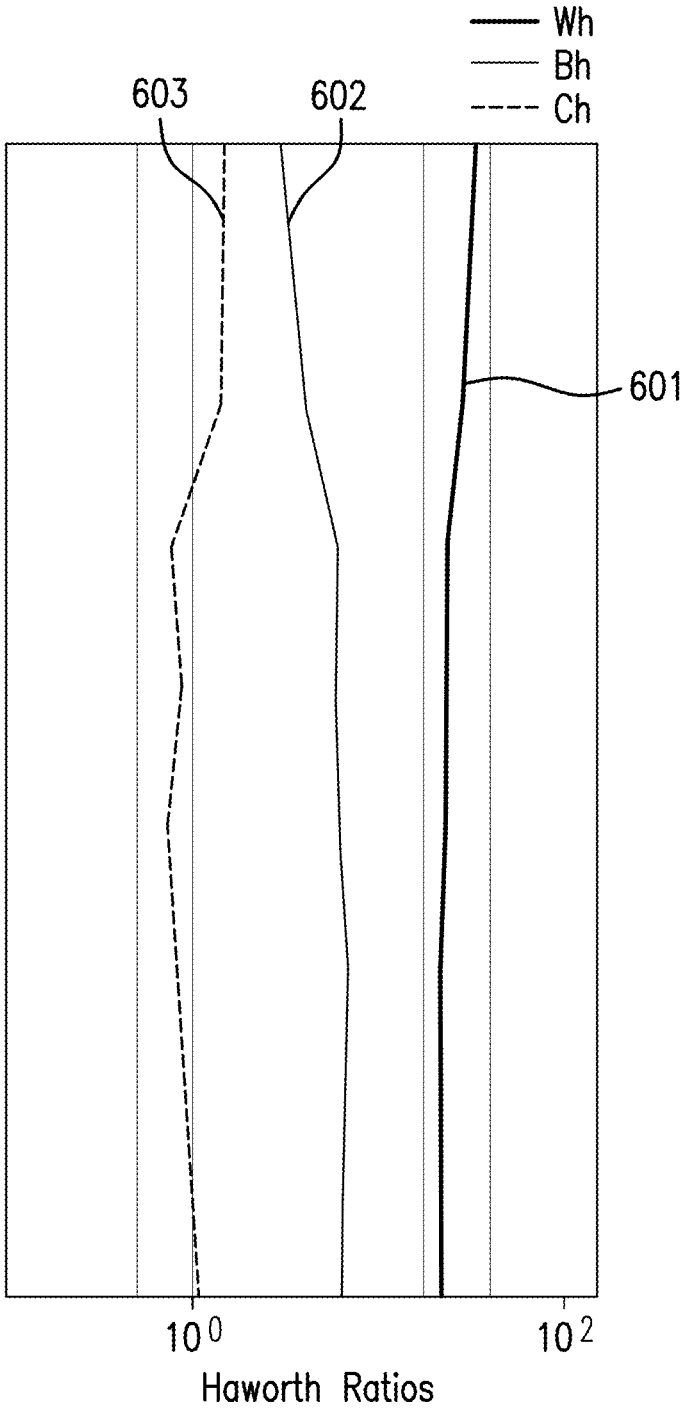
FIG. 6 shows a log of Haworth ratios.

In the example of FIG. 6, the wetness ratio (Wh) is shown as trace 601, the balance ratio (Bh) is shown as trace 602 and the character ratio (Ch) is shown as trace 603.

Other indicators that may be used include an oil indicator and an inverse oil indicator, which are calculated as stated below. These indicators yield information about the fluid type and indicate whether an interval might be productive or not. The data may be displayed on a continuous log as demonstrated by an example shown in FIG. 7.

Oil Indicator:

$$OI = \frac{C3 + C4 + C5}{C1}$$

Inverse Oil indicator:

$$iOI = \frac{C1}{C3 + C4 + C5}$$

Figure 7:
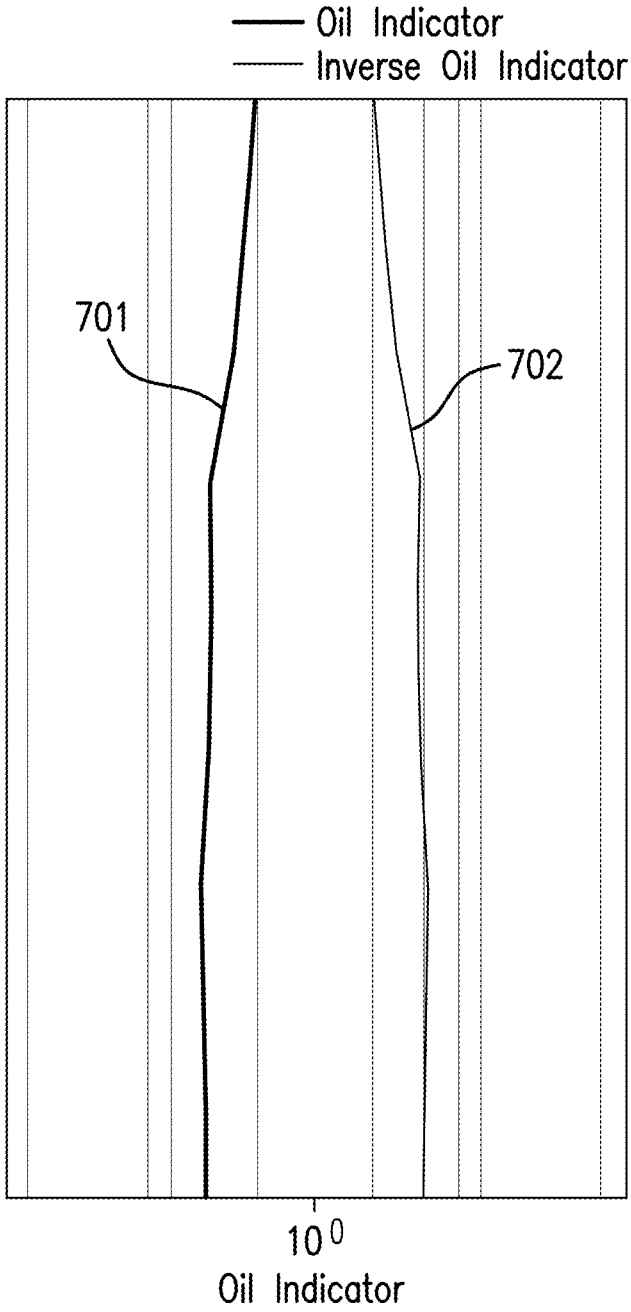
FIG. 7 shows a log of oil indicators.

In the example of FIG. 7, the oil indicator is shown as a trace 701 and the inverse oil indicator is shown as a trace 702.

Figure 8:
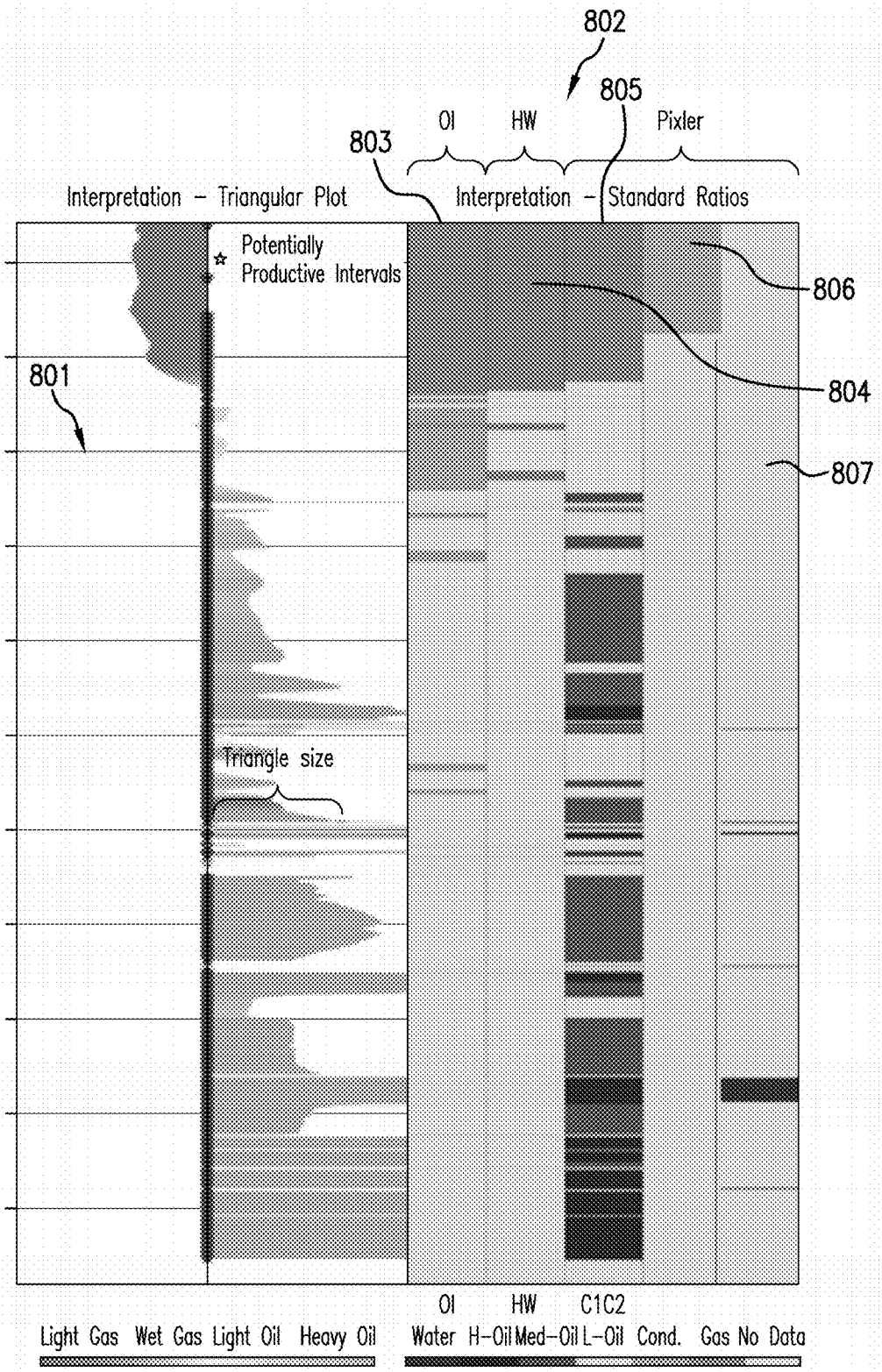
FIG. 8 shows a continuous log according to another embodiment.

The values in [41], in combination with triangular plots, Pixler and Haworth ratios, may be plotted in a depth by depth basis on a continuous log as shown in FIG. 8.

The first column 801 includes an interpretation of the triangular ratios. If the curve plots on the left side, it indicates light hydrocarbons (triangle pointing upwards). If the curve plots on the right side, it indicates heavy hydrocarbons (triangle pointing downwards). The further the curve extends to the left or right side of the plot the larger the triangle would be (indicating fluid density).

The next column 802 combines the interpretations of the other ratios mentioned above (e.g., Oil Indicator (OI), Haworth Ratios (HW), Pixler Ratios). The automated interpretation categorizes them in 5 classes: gas, condensate, light oil, medium oil and heavy oil. Additionally an indication of water is displayed. A first sub-column 803 displays the interpretation of the oil indicator (giving indications about gas, condensate and oil). The second column 804 displays the interpretation of the Haworth ratios (indicating the fluid character). The last three sub-columns 805, 806, 807 are extracted from the Pixler ratios. The sub-column 805 includes the interpretation of the C1C2 ratio (indicating gas, light-, medium- and low gravity oil). Since the condensate range overlaps with the oil and gas ranges, an additional column 806 has been introduced that displays condensate indications. Additionally another column 807 has been added that includes potential water indications. This information is extracted from the slope of the Pixler plot (where negative slope indicates water charged).

The fluid type estimations and/or logs described according to the above embodiments may be used to perform various actions, such as controlling and/or facilitating the performance of aspects of an energy industry operation. Examples of an energy industry operation include drilling, stimulation, formation evaluation, measurement and/or production operations. For example, the fluid type and/or ratio information is used to plan a drilling operation (e.g., trajectory, bit and equipment type, mud composition, rate of penetration, etc.) and may also be used to monitor the operation in real time and adjust operational parameters (e.g., bit rotational speed, fluid flow). In another example, the information is used to plan, monitor and/or control a production operation, e.g., by planning or adjusting operational parameters such as fluid injection parameters and injection locations. Another example of such an action is the evaluation of production performance (e.g., the amount and type of hydrocarbons being produced and/or production rates), which can be used to make determinations regarding the sufficiency of production and/or regarding modifications to production parameters.

Embodiment 1

An apparatus for estimating and displaying formation and formation fluid properties, comprising: a sampling device coupled to borehole fluid circulated through a borehole in an earth formation, the borehole fluid including hydrocarbons released from a region of the formation surrounding an interval of the borehole, the sampling device configured to sample the borehole fluid at a plurality of sample times during a downhole operation; an analysis unit configured to analyze the sample of the borehole fluid at each sample time and estimate amounts of hydrocarbons in the borehole fluid; and a processing device configured to estimate one or more ratios of an amount of at least one hydrocarbon gas to an amount of at least another hydrocarbon gas at each sample time, analyze the one or more ratios to estimate a type of hydrocarbon fluid associated with the ratio, and automatically generate a fluid log that displays an indication of the type at each of the plurality of sample times.

Embodiment 2

The apparatus of any prior embodiment, wherein the one or more ratios include a ratio of an amount of a light hydrocarbon to an amount of one or more heavier hydrocarbons.

Embodiment 3

The apparatus of any prior embodiment, wherein the hydrocarbons are released from the region of the formation as a result of drilling the borehole.

Embodiment 4

The apparatus of any prior embodiment, wherein the processing device is configured to correlate values of the one or more ratios to a fluid type, and display an indicator of at least one of the values and the fluid type in the fluid log.

Embodiment 5

The apparatus of any prior embodiment, wherein the processing device is configured to calculate a permeability index based on the one or more ratios.

Embodiment 6

The apparatus of any prior embodiment, wherein the permeability index is calculated based on a slope of a trace formed by plotting the values of multiple gas ratios for a borehole interval.

Embodiment 7

The apparatus of any prior embodiment, wherein the processing device is configured to estimate traces on a triangular plot of multiple gas ratios, and calculate the permeability index based on a point of intersection between the traces.

Embodiment 8

The apparatus of any prior embodiment, wherein the processing device is configured to estimate a plurality of gas ratios, each gas ratio being a ratio of one hydrocarbon gas type to total gas, plot each gas ratio on a triangular plot, and estimate whether the interval represents a permeable heavier hydrocarbon zone or a permeable lighter hydrocarbon zone.

Embodiment 9

The apparatus of any prior embodiment, wherein the permeability index is calculated based on a value of a Haworth ratio of hydrocarbon gases.

Embodiment 10

The apparatus of any prior embodiment, wherein the permeability index is calculated based on a value of an oil indicator, the oil indicator calculated based on a ratio of a sum of multiple heavy hydrocarbon components to a light hydrocarbon component.

Embodiment 11

A method of estimating and displaying formation and formation fluid properties, comprising: sampling a borehole fluid circulated through a borehole in an earth formation at a plurality of sample times during a downhole operation, the borehole fluid including hydrocarbons released from a region of the formation surrounding an interval of the borehole; analyzing, by an analysis unit, the sample of the borehole fluid at each sample time and estimating amounts of hydrocarbons in the borehole fluid; estimating, by a processing device, one or more ratios of an amount of at least one hydrocarbon gas to an amount of at least another hydrocarbon gas at each sample time, and analyzing the one or more ratios to estimate a type of hydrocarbon fluid associated with the ratio; automatically generating a fluid log that displays an indication of the type at each of the plurality of sample times; and performing aspects of the energy industry operation based on the fluid log.

Embodiment 12

The method of any prior embodiment, wherein the one or more ratios include a ratio of an amount of a light hydrocarbon to an amount of one or more heavier hydrocarbons.

Embodiment 13

The method of any prior embodiment, wherein the hydrocarbons are released from the region of the formation as a result of drilling the borehole.

Embodiment 14

The method of any prior embodiment, wherein generating the fluid log includes correlating values of the one or more ratios to a fluid type, and displaying an indicator of at least one of the values and the fluid type in the fluid log.

Embodiment 15

The method of any prior embodiment, wherein analyzing includes calculating a permeability index based on the one or more ratios.

Embodiment 16

The method of any prior embodiment, wherein the permeability index is calculated based on a slope of a trace formed by plotting the values of multiple gas ratios for a borehole interval.

Embodiment 17

The method of any prior embodiment, wherein analyzing includes estimating traces on a triangular plot of multiple gas ratios, and calculating the permeability index based on a point of intersection between the traces.

Embodiment 18

The method of any prior embodiment, wherein analyzing includes estimating a plurality of gas ratios, each gas ratio being a ratio of one hydrocarbon gas type to total gas, plotting each gas ratio on a triangular plot, and estimating whether the interval represents a permeable heavier hydrocarbon zone or a permeable lighter hydrocarbon zone.

Embodiment 19

The method of any prior embodiment, wherein the permeability index is calculated based on a value of a Haworth ratio of hydrocarbon gases.

Embodiment 20

The method of any prior embodiment, wherein the permeability index is calculated based on a value of an oil indicator, the oil indicator calculated based on a ratio of a sum of multiple heavy hydrocarbon components to a light hydrocarbon component.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention.

The invention claimed is:

1. An apparatus for estimating and displaying formation and formation fluid properties, comprising:

a sampling device coupled to borehole fluid circulated through a borehole in an earth formation, the borehole fluid including hydrocarbons released from a region of the formation surrounding an interval of the borehole, the sampling device configured to sample the borehole fluid at a plurality of sample times during a downhole operation;

an analysis unit configured to analyze the sample of the borehole fluid at each sample time and estimate amounts of hydrocarbons in the borehole fluid; and a processing device configured to estimate one or more ratios of an amount of at least one hydrocarbon gas to an amount of at least another hydrocarbon gas at each sample time, analyze the one or more ratios to estimate a type of hydrocarbon fluid associated with the ratio, and automatically generate a fluid log that displays an indication of the type at each of the plurality of sample times.

2. The apparatus of claim 1, wherein the one or more ratios include a ratio of an amount of a light hydrocarbon to an amount of one or more heavier hydrocarbons.

3. The apparatus of claim 1, wherein the hydrocarbons are released from the region of the formation as a result of drilling the borehole.

4. The apparatus of claim 1, wherein the processing device is configured to correlate values of the one or more ratios to a fluid type, and display an indicator of at least one of the values and the fluid type in the fluid log.

5. The apparatus of claim 1, wherein the processing device is configured to calculate a permeability index based on the one or more ratios.

6. The apparatus of claim 5, wherein the permeability index is calculated based on a slope of a trace formed by plotting the values of multiple gas ratios for a borehole interval.

7. The apparatus of claim 5, wherein the processing device is configured to estimate traces on a triangular plot of multiple gas ratios, and calculate the permeability index based on a point of intersection between the traces.

8. The apparatus of claim 5, wherein the processing device is configured to estimate a plurality of gas ratios, each gas ratio being a ratio of one hydrocarbon gas type to total gas, plot each gas ratio on a triangular plot, and estimate whether the interval represents a permeable heavier hydrocarbon zone or a permeable lighter hydrocarbon zone.

9. The apparatus of claim 5, wherein the permeability index is calculated based on a value of a Haworth ratio of hydrocarbon gases.

10. The apparatus of claim 5, wherein the permeability index is calculated based on a value of an oil indicator, the oil indicator calculated based on a ratio of a sum of multiple heavy hydrocarbon components to a light hydrocarbon component.

11. A method of estimating and displaying formation and formation fluid properties, comprising:

sampling a borehole fluid circulated through a borehole in an earth formation at a plurality of sample times during a downhole operation, the borehole fluid including hydrocarbons released from a region of the formation surrounding an interval of the borehole;

analyzing, by an analysis unit, the sample of the borehole fluid at each sample time and estimating amounts of hydrocarbons in the borehole fluid;

estimating, by a processing device, one or more ratios of an amount of at least one hydrocarbon gas to an amount of at least another hydrocarbon gas at each sample time, and analyzing the one or more ratios to estimate a type of hydrocarbon fluid associated with the ratio;

automatically generating a fluid log that displays an indication of the type at each of the plurality of sample times; and performing aspects of the energy industry operation based on the fluid log.

12. The method of claim 11, wherein the one or more ratios include a ratio of an amount of a light hydrocarbon to an amount of one or more heavier hydrocarbons.

13. The method of claim 11, wherein the hydrocarbons are released from the region of the formation as a result of drilling the borehole.

14. The method of claim 11, wherein generating the fluid log includes correlating values of the one or more ratios to a fluid type, and displaying an indicator of at least one of the values and the fluid type in the fluid log.

15. The method of claim 11, wherein analyzing includes calculating a permeability index based on the one or more ratios.

16. The method of claim 15, wherein the permeability index is calculated based on a slope of a trace formed by plotting the values of multiple gas ratios for a borehole interval.

17. The method of claim 15, wherein analyzing includes estimating traces on a triangular plot of multiple gas ratios, and calculating the permeability index based on a point of intersection between the traces.

18. The method of claim 15, wherein analyzing includes estimating a plurality of gas ratios, each gas ratio being a ratio of one hydrocarbon gas type to total gas, plotting each gas ratio on a triangular plot, and estimating whether the interval represents a permeable heavier hydrocarbon zone or a permeable lighter hydrocarbon zone.

19. The method of claim 15, wherein the permeability index is calculated based on a value of a Haworth ratio of hydrocarbon gases.

20. The method of claim 15, wherein the permeability index is calculated based on a value of an oil indicator, the oil indicator calculated based on a ratio of a sum of multiple heavy hydrocarbon components to a light hydrocarbon component.

* * * * *